United States Patent [19]

Sawyer

[11] 4,089,121

[45] May 16, 1978

[54] METHOD AND APPARATUS FOR CONTROLLING A WET END DRUM OF A STEAM HEATED DRUM DRYER

[75] Inventor: Willard C. Sawyer, Oxford, Me.

[73] Assignee: Gorham International Inc., Gorham, Me.

[21] Appl. No.: 704,428

[22] Filed: Jul. 12, 1976

[51] Int. Cl.[2] ..... F26B 3/24

[52] U.S. Cl. ..... 34/16; 34/48; 34/124; 165/90

[58] Field of Search ..... 34/119, 124, 125, 48, 34/49, 15, 16, 41; 137/145, 616; 251/304; 165/89, 90, 91

[56] References Cited

U.S. PATENT DOCUMENTS

| | | | |
|---|---|---|---|
| 1,192,369 | 7/1916 | Barrus | 34/119 |
| 1,565,772 | 12/1925 | Barrus | 180/74 |
| 1,572,448 | 2/1926 | Simons | 34/124 |
| 1,948,963 | 2/1934 | Dukes | 34/125 |
| 2,102,106 | 12/1937 | Allen | 34/124 |
| 2,366,801 | 1/1945 | Olson | 34/119 |
| 2,561,874 | 7/1951 | Lahman | 34/119 |

*Primary Examiner*—John J. Camby
*Assistant Examiner*—Larry I. Schwartz

[57] ABSTRACT

Method of and apparatus for use in controlling the temperature of a drum of a steam heated drum dryer utilizes air and steam, the air under a pressure control and the steam under a temperature control. The temperature control is responsive to the temperature of the fluids discharged from the drum which are under a control such that the sensed temperature is always substantially the same as that of the interior of the drum and the air and steam is utilized in a manner minimizing fluctuations in the drum temperature as the controls are operated in response to sensed temperature.

4 Claims, 1 Drawing Figure

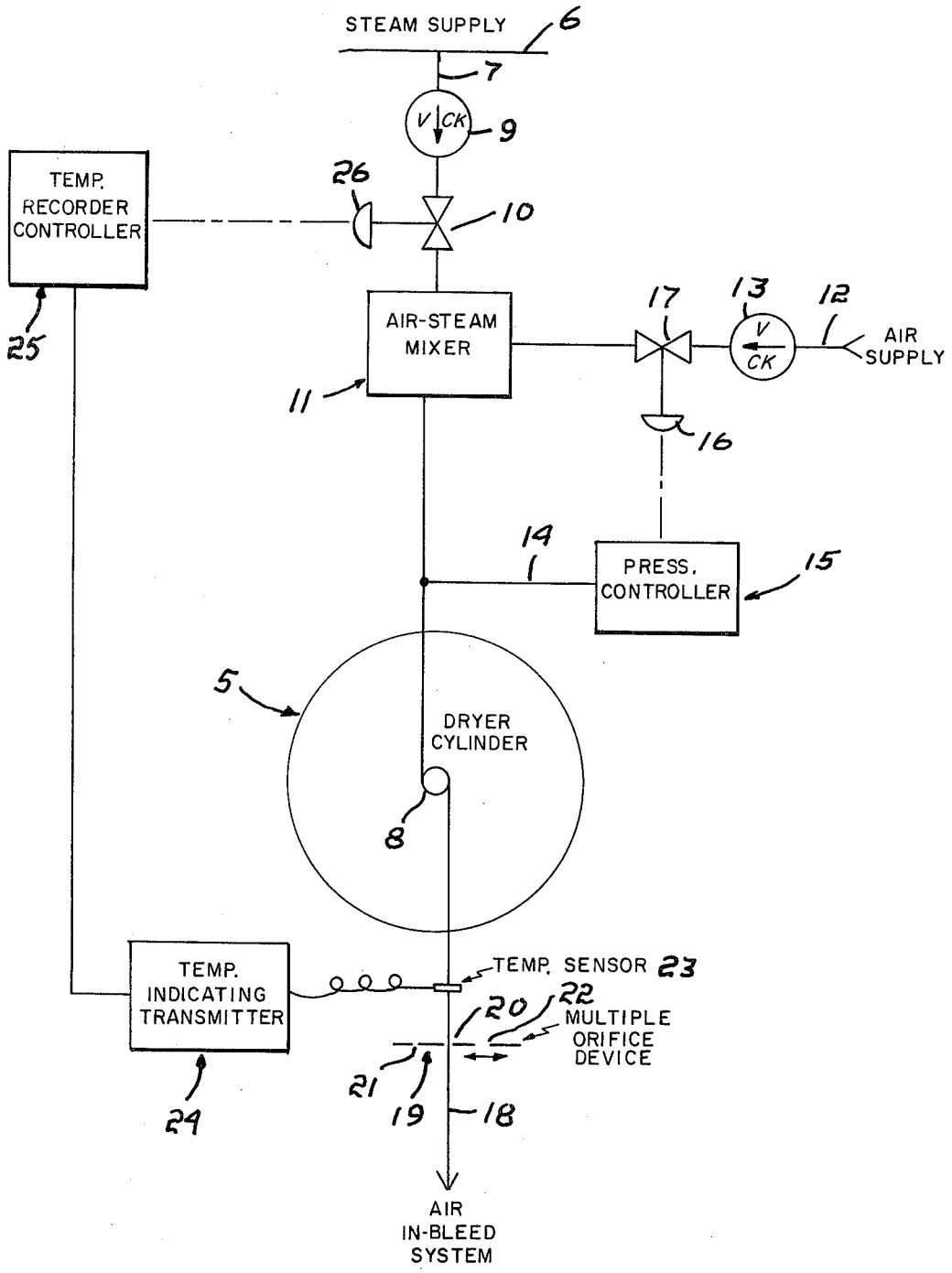
STEAM SUPPLY
6
7
V
CK
9
TEMP. RECORDER CONTROLLER
26
10
25
AIR-STEAM MIXER
11
17
13
12
AIR SUPPLY
16
14
PRESS. CONTROLLER
15
5
DRYER CYLINDER
8
TEMP. INDICATING TRANSMITTER
TEMP. SENSOR 23
20
22
MULTIPLE ORIFICE DEVICE
21
19
18
24
AIR IN-BLEED SYSTEM

METHOD AND APPARATUS FOR CONTROLLING A WET END DRUM OF A STEAM HEATED DRUM DRYER

BACKGROUND REFERENCES

U.S. Pat. No. 1,948,963
U.S. Pat. No. 2,102,106
U.S. Pat. No. 3,869,808
Ser. No. 559,832, filed Mar. 19, 1975 now abandoned.

BACKGROUND OF THE INVENTION

The predominant drying method for paper and paperboard is by contact with steam heated rotatable drums. The temperature sequence to which the web is subjected over the initial series or section of drums is critical for all types of paper and paperboard products. When the temperature of the initial series of drums advances too rapidly, fibers tend to stick to the surface. Sometimes, the fibers are pulled from the web and can be seen on the drum surface to the detriment of the web surface. Many times, however, the fibers remain on the web surface but are partially removed such that the surface strength, Gurley density, and surface smoothness are also reduced. Reduced I.G.T. or wax pick tests indicate the loss in surface strength. Examination under a 40X microscope with low angle light reveals a roughened surface with many loose fibers which interfere with heat transfer on all subsequent cylinders and therefore adversely affect drying rates by 5% to 15%.

Where this problem has been at least in part recognized, steps have been taken to provide lower temperatures for the wet end cylinders. Frequently it is necessary for temperatures to be lower than can be supplied by steam under positive gauge pressure. In such situations blow-through steam from one or more sections is passed to a vacuum condenser where condensing the steam produces a vacuum such that the dryer drums which are connected to the condenser can operate at internal temperatures down to 180° F and still evacuate condensate by differential pressure. Positive control of individaul drum temperatures and reliable internal temperatures below 180° F are not practical with vacuum systems. Furthermore, the transfer of much heat from blow-through steam to condenser cooling water is required to produce the required vacuum. Therefore, this method of obtaining lower temperatures for improved wet end dryer operation can be characterized as being inadequate and grossly wasteful of energy.

In U.S. Pat. No. 2,102,106, apparatus was disclosed that enabled drum temperatures in a desired low temperature range to be attained with positive evacuation of the condensate by introducing air and steam into each wet end drum where a temperature was wanted lower than that possible with steam under positive gauge pressure. To achieve that result, the air was always under sufficient pressure to ensure evacuation of the condensate at all times and the steam was under a separate temperature control.

While that proposal was a step in the right direction in that suitably low temperatures could be attained in wet end drums with drum temperatures increasing in the machine direction, temperature variations caused by the pulsating discharge of condensate across the temperature sensing location, when an orifice is not included, as well as control disturbances caused by one control system bucking the other made positive temperature control impossible. The objective of eliminating the consequences of a too rapid advancement of drum temperature could not be realized.

THE PRESENT INVENTION

The general objectives of the invention are to provide methods of and apparatus by which a desired temperature of a drum of a steam heated drum dryer can be attained and maintained. While a drum or drums in accordance with the invention may be located anywhere lengthwise of the dryer, such a drum is particularly well suited for use in the wet end since the temperature control it provides assures that the development of the previously noticed defects in the material can be avoided. The general objectives are attained by the use of air and steam to heat the drum, the air under a pressure control and the steam under a temperature control responsive to the temperature of fluids discharged from the drum and, the discharged fluids under a control such that the sensed temperature is always substantially the same as that of the interior of the drum and the air and steam utilized in a manner minimizing fluctuations in the drum temperature as the pressure and temperature controls respond, respectively to a sensed temperature or pressure change.

In more detail, the air and steam are delivered into the drum as a homogenous mixture and the condensate conduit is provided with a drop leg portion in which there is an orifice dimensioned to permit the continuous escape, on the average, of all the condensate produced on each revolution of the drum but with condensate building up above the orifice as the percentage of condensate to steam increases above a predetermined maximum. While theoretically the orifice could prevent the escape of any blow-through steam, in practice the condensate build-up above the orifice is such that it separates the steam and condensate except for a short interval when a small volume of blow-through steam is permitted. While the conservation of steam is an important function of the orifice, it is essential to the present invention that the orifice provide a zone outside the drum where the temperature of the escaping fluids is always substantially the same as that inside the drum, the amount of escaping steam being sufficiently small and for such a brief interval that stema waste is minimized. Because of the manner in which the air and steam is utilized, fluctuations of the drum temperature are minimized as the temperature and pressure controls respond, respectively to the sensed temperatures of the discharged fluids and to the pressure of the homogenous mixture. As a consequence, instrument responses are so minimized that the temperature of the drum is constantly maintained at a temperature appropriate for use, particularly in wet end heating, eliminating any temperature variations that could overheat the sheet of material in engagement therewith.

BRIEF DESCRIPTION OF THE DRAWING

The single FIGURE of the accompanying drawing illustrates schematically a wet end drum of a steam heated dryer and the means by which its temperature is controlled in accordance with the present invention.

THE PREFERRED EMBODIMENT OF THE INVENTION

In the drawing, a conventional drum of a steam heated drum dryer is generally indicated at 5 and is a wet end drum requiring that its temperature be lower than that possible with steam under a positive gauge pressure and so controlled to prevent overheating.

The steam supply line 6 has a branch conduit 7 in communication with the interior of the drum through a rotary joint 8, as is conventional. The branch conduit 7 is shown as having a check valve 9, a temperature control valve 10, and a steam and air mixer 11 incorporated therein. The air mixer 11 receives air under pressure from a suitable source, not shown, via a branch air conduit 12 provided with a check valve 13.

The air mixer 11 has the important function of mixing steam and air to provide a homogenous mixture such that it will behave like a mixture of two gases and therefore follow Dalton's law of partial pressure, otherwise simultaneous control of temperatures and pressures is not possible. In practice, the mixer 11 is in accordance with United States Patent No. 3,809,808. The pressure of the mixture is constantly monitored with a branch conduit 14 located between the mixer 11 and the drum 5 in communication with a conventional pressure controller 15, a Foxboro Model 43 Pressure Controller, for example, and operating the control 16 of the regulating valve 17 by which the pressure in the air conduit 12 is automatically adjusted.

A condensate conduit 18 extends concentrically through the rotary joint 8, as is conventional, and is shown as extending downwardly to function as a drop leg which it must have. The condensate conduit 18 is dimensioned to accommodate the maximum possible volume under the pressure within the drum of a combination of condensate, air, and steam discharged from the drum at the maximum possible rate of condensate production, the proportion of steam and condensate varying during each revolution of the drum 5.

A control generally indicated at 19 includes an orifice 20 dimensioned to permit the passage through it of a predetermined rate of condensate production on each revolution of the drum and to reduce the escape of blow-through steam to a desired minimum percentage by weight of the steam required for the desired operation of the drum. The control 19 must be located a sufficient distance below the drum axis so that condensate can accumulate outside the drum and above the orifice as the percentage of condensate in the discharged fluid increases above a predetermined maximum. As a consequence, the orifice 20 functions as a separator blocking passage of steam and with the flow of condensate through the orifice substantially constant and continuous. In addition, the orifice functions to make whatever pressure differential is required to evacuate the cylinder to occur as a pressure drop across the orifice such that the pressure above the orifice is essentially the same as the pressure internal of the cylinder and therefore the temperature at these two locations is also essentially equal. Without the orifice, the relationship between the internal temperature of the drum and the sensed temperature in the drop leg will not hold constant and will not serve as a proper means of controlling the drum temperature. In practice, the escape of steam is permitted once each revolution but for such a brief interval that the temperature and pressure above the orifice is always substantially equal to that in the interior of the drum 5.

In practice, the control 19 is a multiple orifice control as fully described in said copending application and is thus shown as including additional orifices 21 and 22, the orifices 20, 21, and 22 each of a size different than any other and dimensioned to permit the passage therethrough of a predetermined rate of condensate production and together establishing an orifice range providing for the substantially continuous flow of condensate therethrough throughout the limits of the normal operation of the dryer with respect to the speed of the material and related temperature.

In order that a selected orifice may be quickly placed in control of the condensate conduit 18 or removed from such control, the orifices may be, as indicated, in a sliding member or as is also shown in said application they may be placed in series on the conduit 18, arranged in parallel branches therein or incorporated as a rotatable valve.

A temperature sensor 23 in the conduit 18 and above the orifice 20 is connected to a temperature indicating transmitter 24, a Foxboro Model 45P, coupled to a temperature controller 25, a Foxboro #40 Temperature Recorder Controller, which operates the control 26 of the pressure regulating valve 10 by which the temperature of the steam is automatically adjusted.

In operation, air under pressure and steam are delivered into the drum 5 as a homogenous mixture and with the correct orifice in control of the condensate conduit 18, the temperature controller 25 responds continuously to a sensed temperature which is substantially the same as that within the drum 5 and it is operable to lower or increase the volume of steam delivered into the mixer 11. At the same time, the pressure in the system is continuously monitored and the pressure controller 15 modifies the pressure of the air delivered into the mixer 11.

As the air and steam mixture delivered into the drum is homogenous and as the temperature of the discharged fluids outside the drum and above the control 19 is continuously substantially that of the interior of the drum, temperature fluctuations in the course of a temperature correction are so minor that there is no danger of creating defects in the wet end of the dryer due to overheating.

I claim:

1. Apparatus for maintaining a substantially constant control of the temperature of the interior of a drum of a steam heated drum dryer, said apparatus including a flow path through the drum, means operable to introduce a homogenous mixture of steam and air into the infeed portion of said path to maintain the internal drum temperature against any material fluctuation due to the difference in steam and air temperatures, said means including a temperature control for the steam and a pressure control for the air, the outfeed portion of the path dimensioned to accommodate the maximum possible volume under the pressure within the drum of a combination of condensate, air and steam to ensure the discharge of the combination from the drum at the maximum possible rate of condensate production, the proportions of condensate and steam in the combination varying during each revolution of the drum, said outfeed portion including a drop leg section, a control including an orifice of predetermined size in said drop leg section dimensioned to provide a pressure drop effective to ensure that the temperature and pressure of the fluids exteriorly of the drum and above the orifice are substantially those existing interiorly of the drum and to permit the passage therethrough of the entire volume of said combination at a predetermined rate of condensate production on each revolution of the drum, at least on the average, with the flow of condensate therethrough substantially constant and continuous, and with the escape of blow-through steam reduced to a desired minimum percentage by weight of the steam required for the desired operation of the drum and to ensure the removal of air and other non-condensibles, said drop leg section spaced below the drum a distance such that condensate can accumulate outside the drum and directly above the orifice as the percentage of condensate in the flowing combination increases above a predetermined percentage during each revolution of the drum whereby said orifice functions to maintain the temperature and pressure of the fluids in the drop leg section and above the orifice substantially equal to that of the interior of the drum by virtue of the assurance that the pressure drop in the case of the fluids of the combination occurs at the orifice and as a separator by virtue of the accumulated condensate substantially but not completely blocking passage of steam, second means including a stationary sensor above the orifice and operable continuously to monitor the temperature of the fluids in the drop leg section above the orifice and to adjust the steam control and cooperating with said first means to establish a substantially constant desired drum temperature and means continuously operable to monitor the pressure of the mixture and to adjust the air pressure control to ensure adequate pressure for the evacuation of the drum.

2. The apparatus of claim 1 in which said drop leg section control includes orifices in addition to the first named orifice and each is dimensioned to function in the same manner as said first named orifice to discharge the fluids of combinations attendant a predetermined different rate of condensate production, said additional orifices and the first named orifice defining an orifice range for the control of said combination throughout the limits of the normal operation of that drum of the dryer, and means operable to substitute the appropriate one of said additional orifices in control of the drop leg section in substitution for said first named orifice without interference with flow through the outfeed portion of the flow path.

3. The method of maintaining the temperature of the interior of a drum of a steam heated drum dryer substantially constant, said method comprising the steps of providing a flow path through the drum, continuously introducing into the infeed portion of the path steam under a temperature control and air under a pressure control as an homogenous mixture in order to maintain the internal temperature of the drum against fluctuating in response to the difference between steam and air temperatures, the outfeed portion of the path having a drop leg section below the axis of the drum, said outfeed portion dimensioned for the passage of the maximum possible volume of a combination of condensate, air, and steam to ensure the discharge of condensate from the drum at a predetermined rate of its production with the proportion of steam and condensate varying in said combination during each revolution of the drum, providing an orifice dimensioned to provide a pressure drop effective to ensure that the temperature and pressure of the fluids exteriorly of the drum and above the orifice are substantially those existing interiorly of the drum and to permit the passage through the orifice during each revolution of the drum of the entire volume of condensate at a predetermined rate of condensate production, at least on the average, and with the rate of flow of the condensate through that orifice substantially constant and continuous throughout each drum revolution in spite of variations in the proportion of steam and condensate leaving the drum but with the flow of blow-through steam reduced to a desired minimum percentage by weight of the steam required for the desired operation of the drum and to ensure the passage of condensate and air therefrom, placing said orifice in the drop leg section in a stationary position such that during each revolution of the drum, condensate can accumulate directly above the orifice as the percentage of condensate in the combination increases above a predetermined percentage thereby to enable that orifice to function to separate the condensate from the steam with the pressure and temperature between the orifice and the interior of the drum remaining substantially constant, continuously monitoring the temperature of the fluids in the outflow portion above the orifice, adjusting the control of the steam in response thereto to maintain a substantially constant and desired drum temperature, monitoring the pressure of the mixture and adjusting the air control in response thereto to ensure adequate pressure for evacuating the drum.

4. The method of claim 3 and the additional steps of providing orifices in addition to the first named orifice to function in the same manner as said first named orifice to discharge therethrough the fluids of combinations attendant a predetermined different rate of condensate production, providing that the additional orifices and the first named orifice define an orifice range for the control of said combinations throughout the limits of the normal operation of that drum of the dryer, and arranging the additional orifices so that any one of them may be substituted for said first named orifice in said drop leg section without interference with flow through said outfeed portion of the flow path.

* * * * *